US006827243B1

(12) United States Patent
Nuzzolese

(10) Patent No.: US 6,827,243 B1
(45) Date of Patent: Dec. 7, 2004

(54) PORTABLE LIQUID DISPENSING KIT

(76) Inventor: Michael Nuzzolese, 159 Lawn La., Upper Brookville, NY (US) 11771

( * ) Notice: Subject to any disclaimer, the term of this patent is extended or adjusted under 35 U.S.C. 154(b) by 296 days.

(21) Appl. No.: 10/210,165

(22) Filed: Aug. 1, 2002

(51) Int. Cl.[7] ..... F04B 33/00

(52) U.S. Cl. ..... 222/628; 222/108; 222/131; 222/186; 222/269

(58) Field of Search ..... 222/108, 131, 222/135, 173, 184, 186, 269, 608, 628

(56) References Cited

U.S. PATENT DOCUMENTS

| | | | | |
|---|---|---|---|---|
| 221,143 | A | | 11/1879 | Allen |
| 1,896,382 | A | * | 2/1933 | White ..... 222/136 |
| 2,134,865 | A | | 11/1938 | Essery |
| 2,529,407 | A | * | 11/1950 | Midouhas ..... 446/475 |
| 2,575,920 | A | | 11/1951 | Kilpatrick et al. |
| 3,206,075 | A | | 9/1965 | Scholle |
| 3,344,958 | A | | 10/1967 | Kaanehe |
| 4,287,921 | A | | 9/1981 | Sanford |
| 4,472,843 | A | * | 9/1984 | Chermak ..... 4/559 |
| 4,564,132 | A | | 1/1986 | Lloyd-Davies |
| 4,570,830 | A | | 2/1986 | Jeans |
| 4,635,824 | A | | 1/1987 | Gaunt et al. |
| 4,811,872 | A | * | 3/1989 | Boyd ..... 222/610 |
| 5,085,346 | A | | 2/1992 | Wright |
| 5,156,297 | A | * | 10/1992 | Engler ..... 222/23 |
| 5,593,067 | A | | 1/1997 | Shaw et al. |
| 5,690,138 | A | | 11/1997 | Fuller |
| 5,971,209 | A | * | 10/1999 | Bayless ..... 222/135 |
| 6,068,875 | A | | 5/2000 | Miller et al. |

* cited by examiner

*Primary Examiner*—Gene Mancene
*Assistant Examiner*—Melvin A. Cartagena
(74) *Attorney, Agent, or Firm*—Michael I. Kroll

(57) ABSTRACT

A portable kit for transporting and dispensing liquid concentrates for beverage mixing includes receptacles for liquid concentrate containers has locking mechanisms for sealing the containers while not in use, as well as, a removable drip tray with a removable grate.

19 Claims, 6 Drawing Sheets

PORTABLE LIQUID DISPENSING KIT

BACKGROUND OF THE INVENTION

1. Field of the Invention

Figure 1:
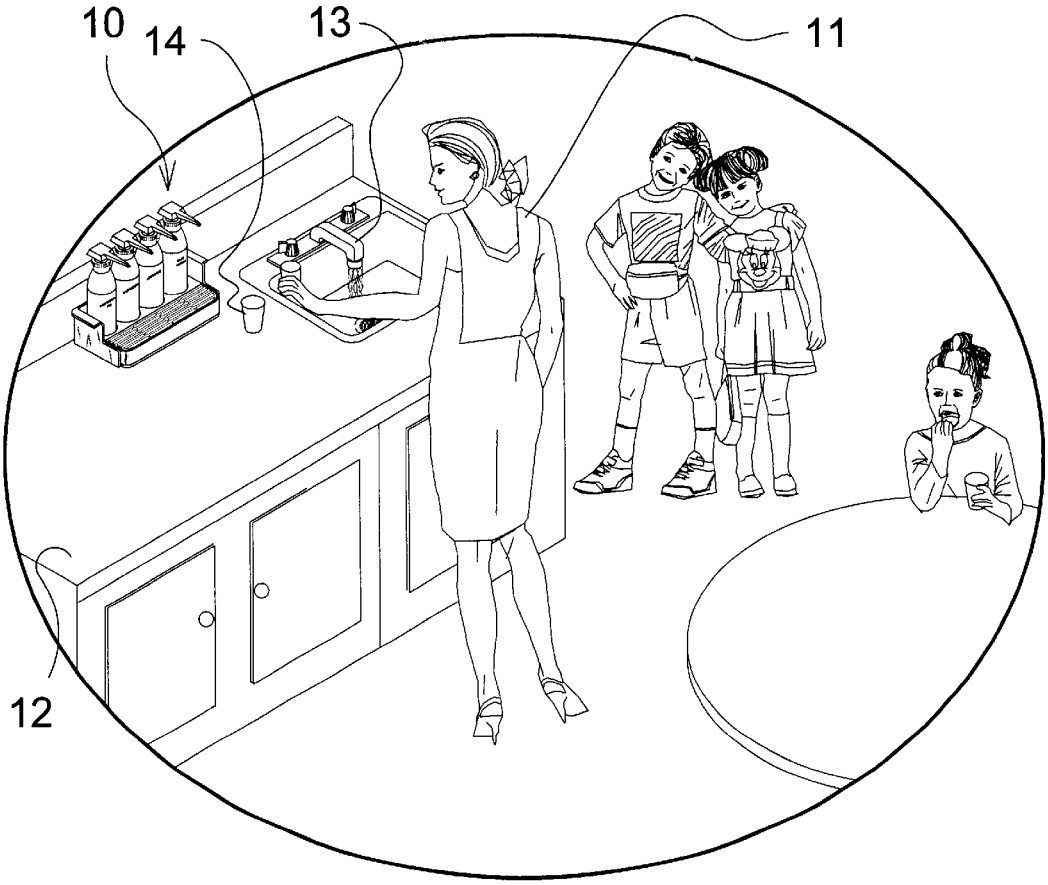

The present invention relates generally to liquid dispensing kits, and more specifically, to a kit for storing a plurality of liquids, preferably concentrated flavored syrups, in separate containers, with each container having its own means for delivering said liquid from therein with the preferable means being a pump with an extended spout.

2. Description of the Prior Art

There are devices designed for dispensing liquids. Typical of these is U.S. Pat. No. 221,143 issued to Theodore Allen on Nov. 4, 1879.

Another patent was issued to Evan R. Essery on Nov. 1, 1938 as U.S. Pat. No. 2,134,865. Yet another U.S. Pat. No. 2,575,920 was issued to William J. Kilpatrick, et al. on Nov. 20, 1951 and still yet another was issued to Wiliam R. Scholle on Sept. 14, 1965 as U.S. Pat. No. 3,206,075.

Another patent was issued to John Kannehe on Oct. 3, 1967 as U.S. Pat. No. 3,344,958. Yet another U.S. Pat. No. 4,287,921 was issued to Robert B. Sanford on Sept. 8, 1981. Another was issued to William T. Lloyd-Davies on Jan. 14, 1986 as U.S. Pat. No. 4,564,132 and still yet another was issued on Feb. 18, 1986 to Edward L. Jeans as U.S. Pat. No. 4,570,830.

Another patent was issued to Lorraine E. Gaunt et al. on Jan. 13, 1987 as U.S. Pat. No. 4,635,824. Yet another U.S. Pat. No. 5,085,346 was issued to Danny J. Wright on Feb. 4, 1992. U.S. Pat. No. 5,593,067 was issued to Theresa M. Shaw et al. on Jan. 14, 1997 and another patent was issued to Lawrence W. Fuller on Nov. 25, 1997, as U.S. Pat. No. 5,690,138. One more patent was issued on May 30, 2000 to Eric R. Miller et al. as U.S. Pat. No. 6,068,875.

U.S. Pat. No. 221,143

Inventor: Theodore Allen

Issued: Aug. 4, 1879

A means for transporting liquids in packages so arranged that the means for drawing the contents are fully protected. The case used has movable covers and an opening for a faucet.

U.S. Pat. No. 2,134,865

Inventor: Evan R. Essery

Issued: Nov. 1, 1938

A lubricating oil storing and dispensing device comprising a compact, upright frame provided with apertures and supports constructed and arranged to receive a plurality of drawer-like tanks disposed in tiers, a plurality of drawer-like tanks disposed in tiers within said apertures, said tanks having portions for sliding cooperation with said supports whereby any one of said tanks can be pulled out from said frame for filling and gauging, a faucet for each of said tanks located at the lower, front exterior portion thereof, whereby liquid can be dispensed from any one of said tanks, said filling openings being provided with hinged covers carried by the tops of said tanks, said frame being provided with stops to limit the extent to which said tanks can pulled out from said frame, said stops being operative at a point where the cover of a lower tank, when the tank is pulled out to the stop position and the cover is raised, will clear the faucet of the next higher tank.

U.S. Pat. No. 2,575,920

Inventor: William J. Kilpatrick et al.

Issued: Nov. 20, 1951

In a dispensing mechanism for bulk material, a container for such material having a downwardly directed outlet formed within an annular neck of the container, such neck having a screw thread and a projecting lug, a centrally orificed closure disk for said outlet seated on said neck and peripherally notched to receive said lug, being thus restrained from rotation, and annular cap having a thread engaging the neck thread for detachably mounting said disk on said neck, and a shutter mounted on the disk for opening and closing the orifice of the closure.

U.S. Pat. No. 3,206,075

Inventor: William R. Scholle

Issued: Sept. 14, 1965

A compact and simple spigot which can be composed principally of plastic such as polyethelene, and which will withstand changes in temperature such as refrigeration, and which may be employed in association with a nozzle secured to a plastic liner when the liner is disposed in a supporting paperboard container for the dispensing of the contents thereof, suitably milk, the entire assembly being adapted for being disposed in a refrigerated chamber.

U.S. Pat. No. 3,344,958

Inventor: John Kaanehe

Issued: Oct. 3, 1967

A dispenser for powdered material from the original package with a walled holder for the package, a hopper below the package to direct the package contents by gravity to a valve for discharge of the powered material into a receiving area without spillage of the powder laterally of the hopper.

U.S. Pat. No. 4,287,921

Inventor: Robert B. Sanford

Issued: Sep. 8, 1981

A canister set for dispensing measured amounts of flowable solids has a common support. Each canister of the set has a removable trap chamber for residue solids which may be cleaned out at intervals. The trap chamber of each canister is engaged by a receiver vessel and shifted to a material dispensing position. A mechanism on each canister is engaged and activated by the movable trap chamber to shift a closure slide at the bottom of a material measuring chamber to an open dispensing position where the flowable solids can gravitate into the receiver vessel. Substantially simultaneously an upper closure for the measuring chamber cuts off the flow of material thereto from an overhead storage hopper during the dispensing operation. A spring automatically returns each trap chamber and associated mechanism to its normal position.

U.S. Pat. No. 4,564,132,

Inventor: William T. Lloyd-Davies

Issued: Jan. 14, 1986

A fluid dispensing assembly is disclosed which includes a connector valve and a diaphragmic container valve that permits a fluid dispensing passageway to be connected to a disposable container of fluid in a simple, efficient manner to provide continuous fluid flow. The connector valve engages the container valve to simultaneously open both the container valve and the connector valve in a single connecting step to dispense fluid from the container into the dispensing passageway. Upon disengagement of the valves, both valves simultaneously close. The assembly is simple, lightweight and inexpensive, thereby being particularly suitable for use with lightweight disposable fluid containers.

U.S. Pat. No. 4,570,830

Inventor: Edward L. Jeans

Issued: Feb. 18, 1986

Apparatus for controlling the dispensing of a concentrate from a container at a predetermined flow rate includes a first container part a first valve part in communication with a volume of concentrate; a second part having a second mating valve part and an outlet opening therein, the second part movable with respect to the first part to selectively move the first and second valve parts with respect to each other by a preselected amount to permit flow of the concentrate from the first part, through the valve parts and out the outlet opening; cams for effecting movement of the first and second parts, the preselected amount with respect to each other; a tube to introduce air at atmospheric pressure into the container when the first and second valve parts are moved apart having a cooperating valve to prevent backflow through the tube when the first and second valve parts are in sealing relationship; and a chamber interposed between the volume of concentrate and the tube having an outlet fixed near the outlet opening, the chamber outlet being of a size which will permit a free flow of air whereby air will escape from the chamber, despite any surface tension existing in the concentrate, to replace concentrate which is dispensed through the outlet opening in such a manner so as to maintain a constant head pressure in the interior of the container.

U.S. Pat. No. 4,635,824

Inventor: Lorraine E. Gaunt et al.

Issued: Jan. 13, 1987

A post-mix beverage dispensing system of a small size and capacity includes a minimal number of cabinet-mounted dispensing valve assemblies to be used in combination with a larger number of syrup valve adapter assemblies. The adapter assemblies are attached to removable syrup containers and are removable from the cabinet-mounted valve assemblies with the containers. The adapter assemblies include syrup outlet tubes with flow-rate orifice plates matched to predetermined brix values of syrup flavors. A valve actuation assembly is provided which may selectively dispense either soda water alone or a carbonated post-mix beverage.

U.S. Pat. No. 5,085,346

Inventor: Danny J. Wright

Issued: Feb. 4, 1992

A kit for facilitating bulk shipment, storage and dispensing of fluids, comprising in combination: a carton having an internal cavity divided into a main chamber and a second chamber; a first deformable flap for providing a reclosable first passageway into the main chamber; a second deformable flap for providing a reclosable passageway into the second chamber; a window rendering a portion of the main chamber visible from outside the carton; a transparent collapsible container positioned inside the main chamber for storing and dispensing fluids; a retractable/extendable dispensing spigot communicating with the interior of the container; and a transparent portable dispenser removably housed in the second chamber. The dispensing spigot is extendable from a first, shipping position, wherein it is retracted to a position within the main chamber to a second, dispensing position, wherein it is extended through the first passageway and secured in the extended position by the first deformable flap. A transparent portable dispenser is removably housed in the second chamber of the carton and accessible via the second passageway. The kit is adapted to facilitate color differentiation of a plurality of fluids, each fluid having a different color; its color being visible through the window, the transparent container, and the transparent portable dispenser. Markings are provided designating the contents and proper use of the particular fluid contained in the kit; the markings conforming in color to the color of the fluid stored therein.

U.S. Pat. No. 5,593,067

Inventor: Teresa M. Shaw, et al.

Issued: Jan. 14, 1997

A modular household dispenser for fluent solids or liquids includes a rectangular casing mounted on a wall or beneath a cupboard, and a hopper slidably mounted in the open front end of the casing. The hopper includes an inverted frusto-pyramidal bottom, the dispensing lower end of which is closed by a valve. Springs bias the valve to a closed position, whereby the valve automatically closes following a dispensing operation. During use, the hopper is slid outwardly to a dispensing position. A small container is located beneath the valve in the dispensing position for receiving any overflow. Upon completion of a dispensing operation, the hopper is slid inwardly to the storage or non-use position. The entire structure is simple, compact and easy to install and use.

U.S. Pat. No. 5,690,138

Inventor: Lawrence W. Fuller

Issued: Nov. 25, 1997

A receptacle for a dripping spigot including a base member having an open upper end, a closed lower end and a cylindrical side wall therebetween. A back splash member extends upwardly from the open upper end of the base member. A securement aperture is formed through the back splash member downwardly of an upper end thereof. The securement aperture is dimensioned for receiving a spigot therethrough for attachment of the receptacle to catch drips therefrom.

U.S. Pat. No. 6,068,875

Inventor: Eric R. Miller et al.

Issued: May 30, 2000

A method for preparing a flavored slurried confection includes the use of a disposable serving container holding an individual serving of a neutral flavored mix which has a freezing point temperature lower than normally found for that of water. A large supply of the mix filled containers is stored in a storage freezer for maintaining the neutral flavored mix at a storage temperature, such as is typical of a food storage freezer for a restaurant. A desired quantity of the mix filled containers is then transferred from the storage freezer to a tempering freezer, generally close to a preparation and serving area, for maintaining the neutral flavored mix at a desirable blending temperature. The mix filled container is then removed from the tempering freezer for preparation of a flavored confection, such as a flavored shake. In preparing the flavored confection, a small quantity of a selected syrup is pumped from a selected bag-in-the-box styled carton into the mix filled container for blending the selected syrup with the neutral flavored mix while the mix remains chilled at the blending temperature. The small quantity of syrup added provides the selected flavor to the neutral flavored mix for forming the flavored slurried confection which is then served within the disposable serving container.

While these liquid dispensing devices may be suitable for the purposes for which they were designed, they would not be as suitable for the purposes of the present invention, as hereinafter described.

SUMMARY OF THE PRESENT INVENTION

A primary object of the present invention is to provide a portable liquid dispensing kit for storing a plurality of containers and delivering the liquids therein to a user upon demand.

An additional object of the present invention is to provide a portable liquid dispensing kit for storing different flavored liquid concentrates such as syrups.

A further object of the present invention is to provide a portable liquid dispensing kit wherein the different flavored syrups are delivered to the user by means of spring-operated pumps with extended spouts.

A yet further object of the present invention is to provide a portable liquid dispensing kit having a removable drip tray.

Another object of the present invention is to provide a portable liquid dispensing kit having means for securing the liquid containers.

Still another object of the present invention is to provide a portable liquid dispensing kit having non-skid rubber feet to keep the present invention from sliding on the surface on which it is resting.

One more object of the present invention is to provide a portable liquid dispensing kit that is simple and easy to use.

A further object of the present invention is to provide a portable liquid dispensing kit is economical in cost to manufacture.

Further objects of the present invention will appear as the description proceeds.

The present invention fixes a plurality of liquid containers within individual receptacles in a housing, where the housing has a removable drip tray positioned beneath the spouts on the containers. The removable drip tray has a removable grate and the housing has skid-resistant feet and protective sidewalls with integral handles.

The present invention is optimally placed in the vicinity of a potable water source, such as a water faucet or a water cooler, so a user can fill a cup with water from the source and then have a choice of different flavored concentrates to place therein.

The present invention provides a quick, easy and economical way to provide a plurality of beverage options from a single source at home, work or at play.

My invention provides kit for transporting and using liquid containers, the containers having a bottle portion having a base, the container further having a pump and a spout for pumping liquid from the container, comprising: a housing assembly having: a base; a back wall; and a left sidewall and a right sidewall extending from the back wall, the left and right sidewalls each having an outwardly-curved top portion extending from the walls in a substantially horizontal orientation, the left and right sidewalls each having a forwardly-extending portion of reduced height; a retainer portion having a plurality of receptacles, each receptacle shaped for receiving one of the container bottle portions; a tray, the tray having a basin, the tray being shaped for frictional securement between and against the left and right sidewalls' forwardly-extending portions, the liquid container spout being positioned to discharge liquids above the tray, the tray being removable; and a grate positioned on the tray, the grate being removable from the tray.

In one embodiment, the container bottle portions fit tightly within the receptacles, the tight fit securing the containers in the receptacles to the extent necessary to overcome gravity when the retainer portion is inverted.

In one embodiment, each receptacle has a side wall, the retainer portion further comprising a frictional element attached to the sidewall to frictionally secure the containers within the receptacles.

In one embodiment, the frictional element is a cupped insert within the receptacle.

In one embodiment, the housing further comprises anti-skid feet attached to the base.

In one embodiment, the container pump has a locking mechanism, such that the locking mechanism secures the spout in a down position with no liquid discharge, and alternatively, the locking mechanism secures the spout in an up position allowing liquid discharge through the spout when the spout is depressed.

In one embodiment, the pump locking mechanism is put in the locked position by pushing down on the spout and rotating the spout while the spout is down.

In one embodiment, the container bottle portion further comprises a cap and a threaded top opening for attaching the cap, the pump being attachable to the container bottle portion threaded top opening when the cap is threadably removed.

In one embodiment, the left and right sidewalls' forwardly extending portions have a forward end, each of the forward ends being curved inwardly to partially encompass the tray.

There is provided a kit for transporting and dispensing liquid beverage mixes, comprising: a plurality of containers, each container having a bottle portion having a base, each container further having a pump and a spout for pumping liquid from the container; a housing assembly having: a base; a back wall; and a left sidewall and a right sidewall extending from the back wall, the left and right sidewalls each having an outwardly-curved top portion extending from the walls in a substantially horizontal orientation, the left and right sidewalls each having a forwardly-extending portion of reduced height; a retainer portion having a plurality of receptacles, each receptacle shaped for receiving one of the container bottle portions; a tray, the tray having a basin, the tray being shaped for frictional securement between and against the left and right sidewalls' forwardly-extending portions, the liquid container spout being positioned to discharge liquids above the tray, the tray being removable; and a grate positioned on the tray, the grate being removable from the tray.

In one embodiment, the container bottle portions fit tightly within the receptacles, the tight fit securing the containers in the receptacles to the extent necessary to overcome gravity when the retainer portion is inverted.

In one embodiment, each receptacle has a side wall, the retainer portion further comprising a frictional element attached to the sidewall to frictionally secure the containers within the receptacles.

In one embodiment, the frictional element is a cupped insert within the receptacle.

In one embodiment, the housing further comprises anti-skid feet attached to the base.

In one embodiment, the container pump has a locking mechanism, such that the locking mechanism secures the spout in a down position with no liquid discharge, and alternatively, the locking mechanism secures the spout in an up position allowing liquid discharge through the spout when the spout is depressed.

In one embodiment, the pump locking mechanism is put in the locked position by pushing down on the spout and rotating the spout while the spout is down.

In one embodiment, the container bottle portion further comprises a cap and a threaded top opening for attaching the cap, the pump being attachable to the container bottle portion threaded top opening when the cap is threadably removed.

In one embodiment, the left and right sidewalls' forwardly extending portions have a forward end, each of the forward ends being curved inwardly to partially encompass the tray.

There is provided a kit for transporting and dispensing liquid beverage mixes, comprising: a plurality of containers, each container having a bottle portion having a base, each container further having a pump and a spout for pumping liquid from the container; a housing assembly having: a base; a back wall; a left sidewall and a right sidewall extending from the back wall; and handle means for grasping the housing; retainer means for receiving each of the container bottle portions; drip control means secured in the housing, for catching and holding liquid drips from the container spouts; and grate means on the drip control means.

In one embodiment, the container bottle portions fit tightly within the retainer means, the tight fit securing the containers to the extent necessary to overcome gravity when the retainer means is inverted.

In one embodiment, the housing further comprises anti-skid means for preventing the housing from sliding.

In one embodiment, the container pump has locking means, such that the locking means secures the spout in a down position with no liquid discharge, and alternatively, the locking means secures the spout in an up position allowing liquid discharge through the spout when the spout is depressed.

In one embodiment, the pump locking means is put in the locked position by pushing down on the spout and rotating the spout while the spout is down.

A kit is provided for transporting and dispensing liquid beverage mixes, comprising: a plurality of containers, each container having a bottle portion having a base, each container further having a pump and a spout for pumping liquid from the container, the container pump having a locking mechanism, such that the locking mechanism secures the spout in a down position with no liquid discharge, and alternatively, the locking mechanism secures the spout in an up position allowing liquid discharge through the spout when the spout is depressed, the pump locking mechanism being put in the locked position by pushing down on the spout and rotating the spout while the spout is down, and further wherein the container bottle portion further comprises a cap and a threaded top opening for attaching the cap, the pump being attachable to the container bottle portion threaded top opening when the cap is threadably removed; a housing assembly having: a base; a back wall; a left sidewall and a right sidewall extending from the back wall, the left and right sidewalls each having an outwardly-curved top portion extending from the walls in a substantially horizontal orientation, the left and right sidewalls each having a forwardly-extending portion of reduced height; and anti-skid feet attached to the base; a retainer portion having a plurality of receptacles, each receptacle shaped for receiving one of the container bottle portions, each receptacle having a side wall, the retainer portion further comprising a cupped frictional element attached to the sidewall to frictionally secure the containers within the receptacles; a tray, the tray having a basin, the tray being shaped for frictional securement between and against the left and right sidewalls' forwardly-extending portions, the liquid container spout being positioned to discharge liquids above the tray, the tray being removable; and a grate positioned on the tray, the grate being removable from the tray.

To the accomplishments of the above and related objects, this invention may be embodied in the form illustrated in the accompanying drawings, attention being called to the fact, however, that the drawings are illustrative only, and that changes may be made in the specific construction illustrated and described in the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

FIG. 1 is a perspective view of the present invention in a residential use. Shown is a residential use of the present invention. The kit housing holder has a plurality of cavities for the placement therein of syrup dispensing containers. The syrup dispensing containers have a pump mechanism providing access to the syrup. The pump mechanism spout can be alternated between a depressed locked position and an extended position for pumping.

Figure 2:
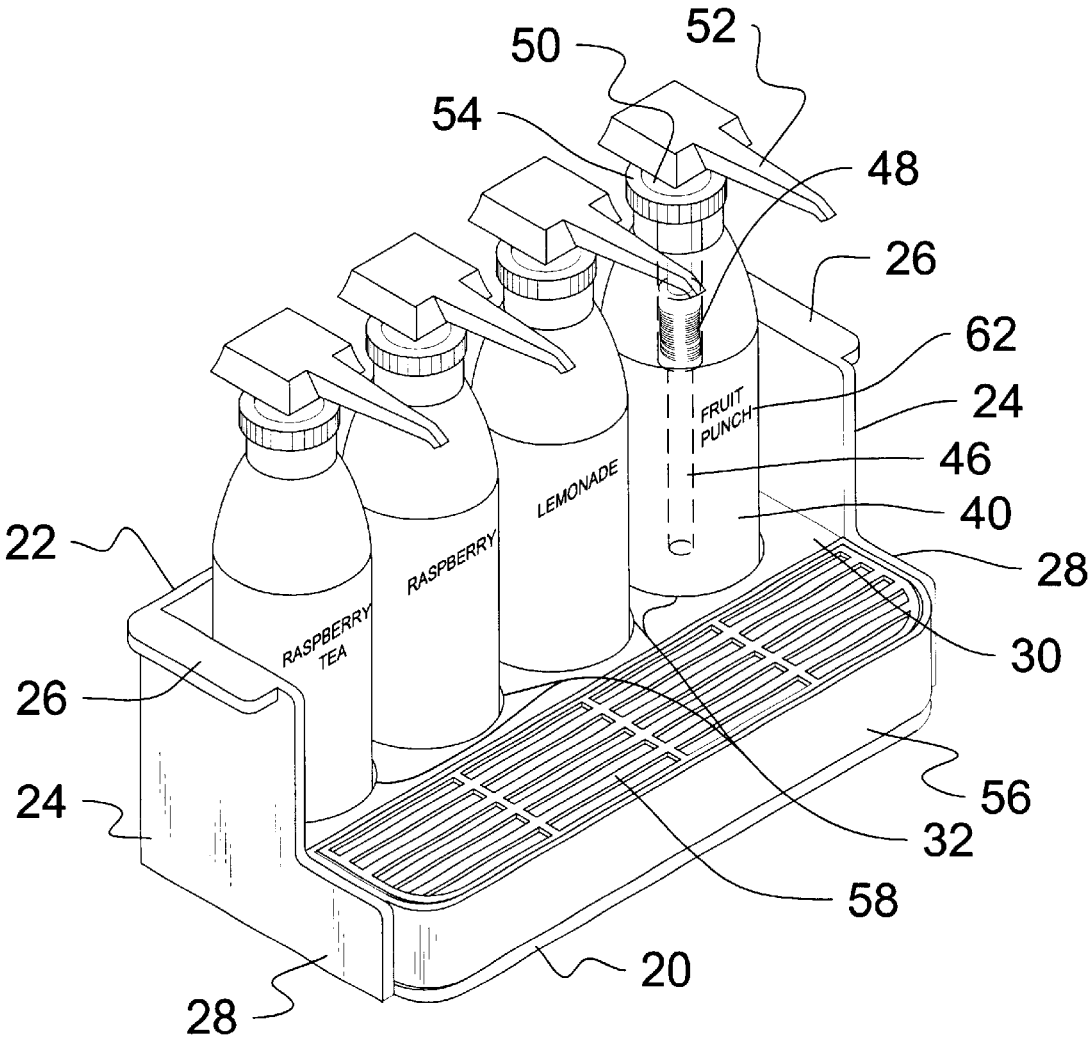

FIG. 2 is a perspective view of the present invention. Shown are the flavored syrup containers placed within the bottle cavities of the syrup dispenser. The syrup contents have the spouts in the down, locked positions to prevent unintended discharge of the contents. Twisting the spout will release the locking mechanism and a spring mechanism (shown in hidden line) will bias the spout in an upward position while priming the pump.

Figure 3:
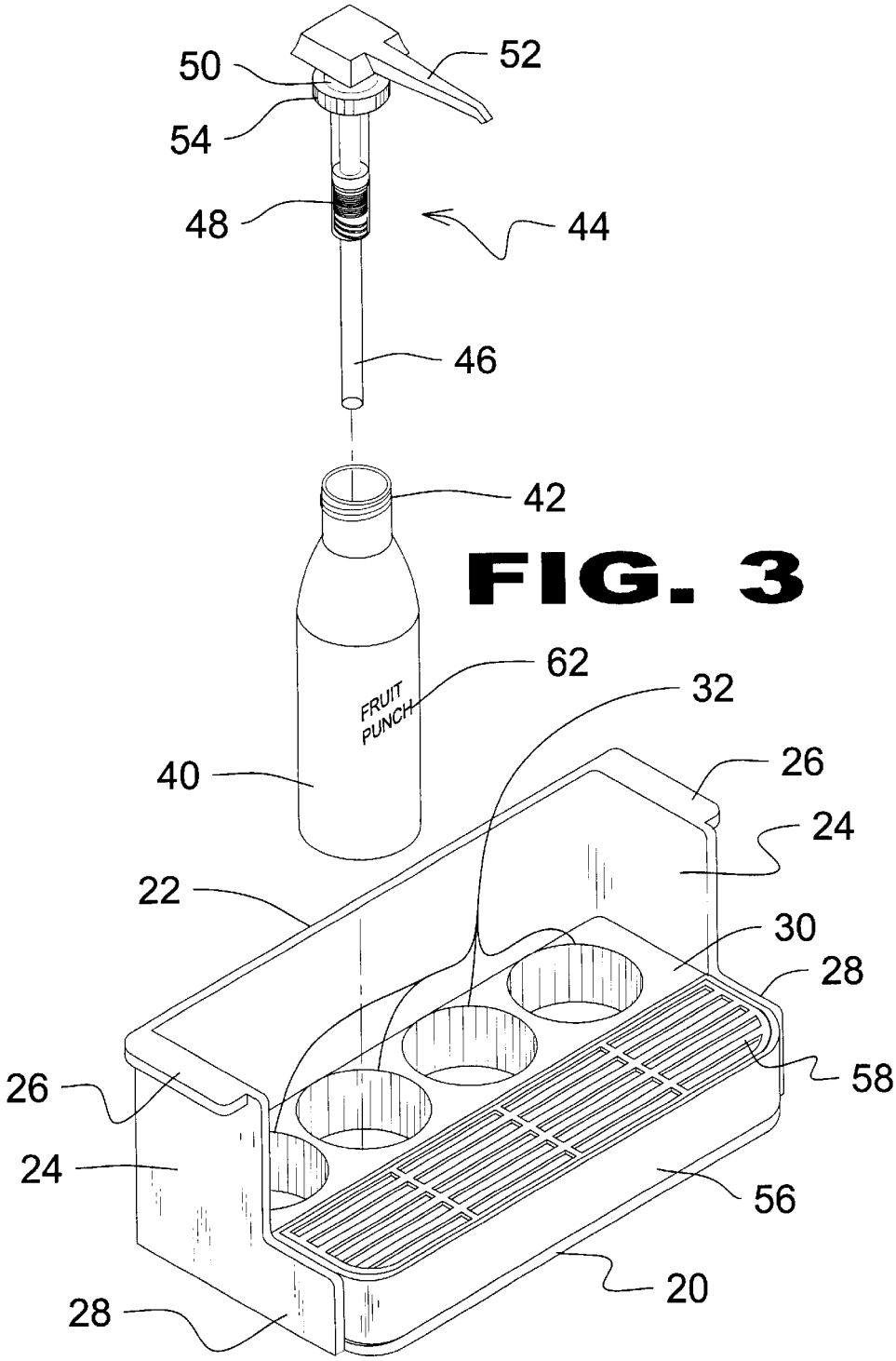

FIG. 3 is an exploded view of the syrup containers of the present invention.

Figure 4:
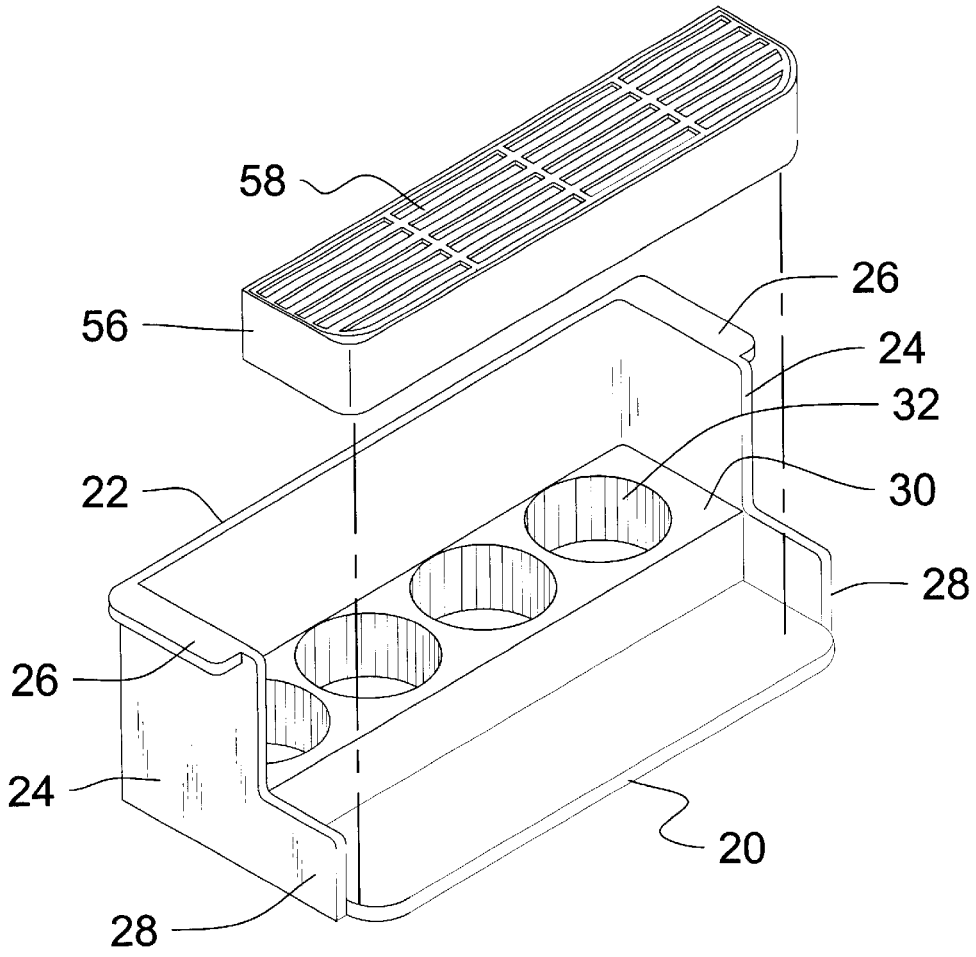

FIG. 4 is an exploded view of the housing assembly. The removable drip tray is a receptacle placed under the container spouts for capturing spills. The drip tray has a removable grate for cleaning purposes.

Figure 5:
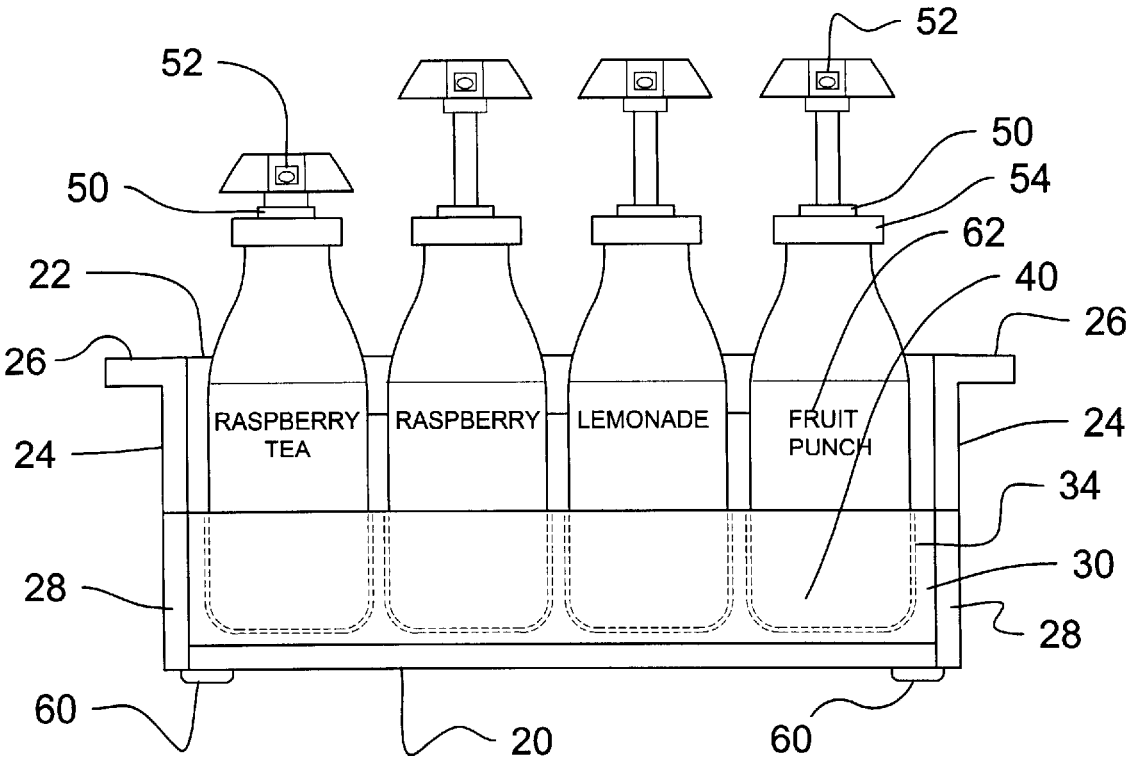

FIG. 5 is a front view of the present invention with the drip tray removed. Shown in sectional hidden line are the friction elements within each receptacle. The liquid containers are frictionally secured within the receptacles by the friction elements. The frictional forces help to steady the bottle as the pump is being used, as well as, preventing small children from removing the syrup dispensing bottles from the housing.

Figure 6:
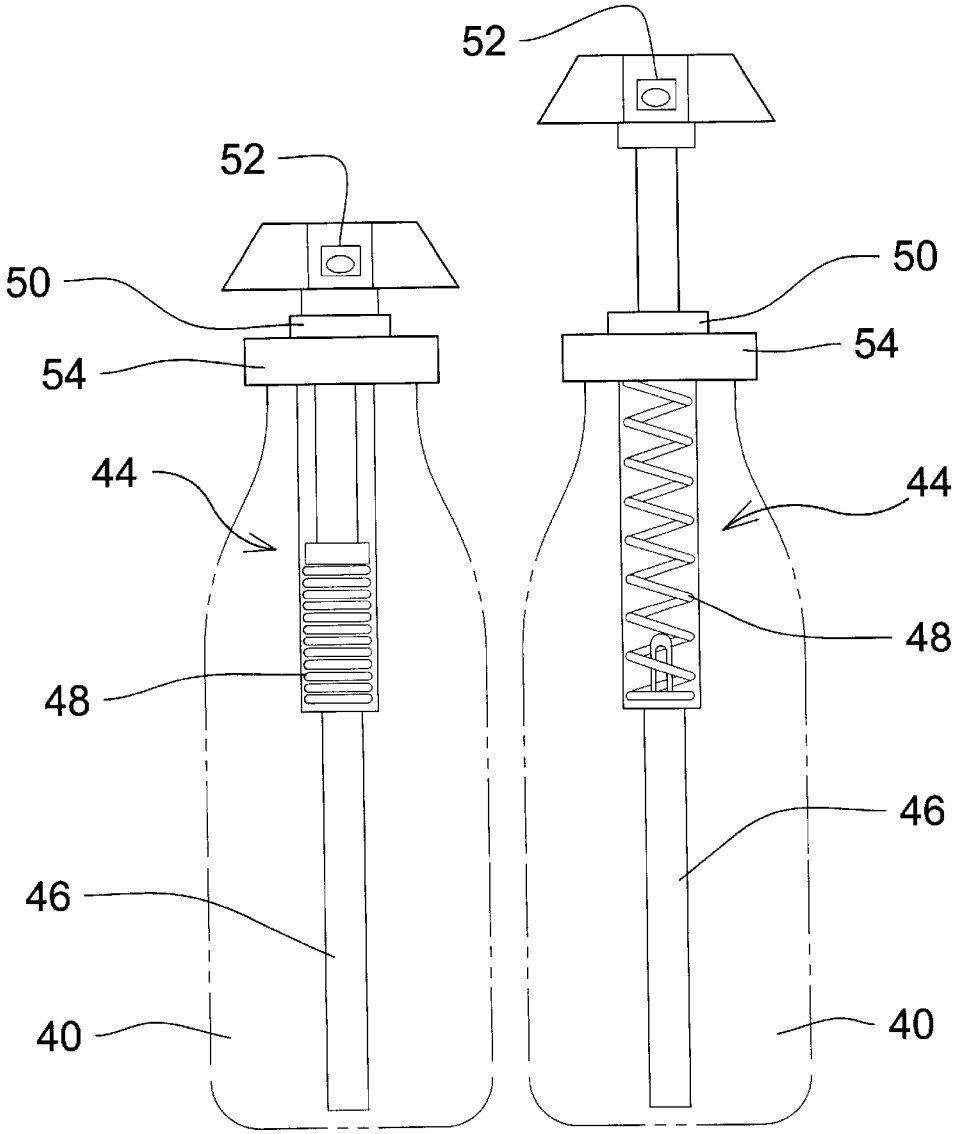

FIG. 6 is a front view of two liquid containers. The pump assemblies of the present invention have an optional twist lock mechanism to prevent the accidental expulsion of flavored syrup when not in use. The container on the right has the lock mechanism released and is in the primed open position and is ready to operate. The container to the left is in the locked position.

DESCRIPTION OF THE REFERENCED NUMERALS

Turning now descriptively to the drawings, in which similar reference characters denote similar elements throughout the several views, the figures illustrate the present invention. With regard to the reference numerals used, the following numbering is used throughout the various drawing figures.

10 Portable Liquid Dispenser Kit of the present invention
11 user
12 counter surface
13 water faucet
14 cups
20 base
22 back wall
24 sidewalls
26 sidewall handle extensions
28 sidewall forward extensions
30 retainer portion
32 retainer portion receptacles
34 receptacle inserts
40 container bottle portion
42 bottle portion threaded opening
44 pump
46 pump intake conduit
48 spring
50 locking mechanism
52 spout
54 container threaded cap
56 drip tray
58 grate
60 non-skid feet
62 container indicia

DETAILED DESCRIPTION OF EXEMPLARY EMBODIMENTS OF THE INVENTION

The following discussion describes in detail exemplary embodiments of the invention. This discussion should not be construed, however, as limiting the invention to those particular embodiments. Practitioners skilled in the art will recognize numerous other embodiments as well. For a definition of the complete scope of the invention, the reader is directed to the appended claims.

The kit 10 is shown in use in FIG. 1 by user 11, the kit 10 being positioned on a counter surface 12 in proximity to a potable water faucet 13, with a supply of cups 14 available.

As shown in FIG. 2 the kit 10 has a housing with a base 20, a back wall 22, a pair of sidewalls 24, and sidewall handle extensions 26. The sidewalls 24 each have a reduced height forward extension 28.

Recessed into the enclosure formed by the base 20, back wall 22, and sidewalls 24 is a retainer structure 30 having four circular receptacles 32. Each receptacle 32 has a cup-shaped insert 34 attached within, as shown in FIG. 3 and FIG. 5.

The kit 10 includes four containers each container having a bottle portion 40 with a threaded top opening 42 for threadably attaching to a conventional cap prior to inclusion of the container in the kit 10. The bottle portion 40 is secured within the receptacles 32, the receptacle inserts 34 engaging the bottle portion 40 frictionally such that the bottle portion 40 is secured within the receptacle 32, even if the kit 10 is inverted. (In other embodiments, the receptacles and container bottle portions are non-circular, and the number of receptacles and containers varies.)

In other embodiments, the receptacle has no insert and it is the tight fit of the bottle portion in the receptacle that frictionally secures the bottle portion within the receptacle.

As shown in FIG. 3, each container also has a pump 44 with an intake conduit 46, a spring 48, a locking mechanism 50, a spout 52, and a threaded cap 54 for threadably attaching to the bottle portion threaded opening 42. The spout 52 cooperates with the locking mechanism 50 and its spring 48, such that the spout 52 can be pushed down and twisted to lock the spout 52 in the down position, as shown in FIG. 5. No liquid can be dispensed while the spout 52 is in the locked position. Untwisting will release the locking mechanism 50 and allow the spout 52 to elevate to the up position where further downward movement of the spout 52 in response to the user 11 pushing the spout 52, without twisting, will force the liquid to be dispensed. The up and down spout 52 positions are illustrated in FIG. 5 and FIG. 6.

As shown in FIG. 4, a removable drip tray 56 is positioned between the sidewalls' forward extensions 28. The fit is tight such that the tray 56 is prevented from sliding out when the housing base 20 is tilted or inverted. (In another embodiment, the forward extensions curve to partially encompass the tray, as a further or independent means to prevent the tray from sliding.)

Nested within the tray 56 is a removable grate 58 that is also tightly fitted in the tray 56 such that the grate 58 is retained when the kit 10 is tilted or inverted.

The drip tray 56 is positioned beneath each container spout 52 such that all drips and other liquid discharges that miss the intended cup 14 will enter the drip tray 56 through the grate 58.

As shown in FIG. 5, the base 20 has a plurality of feet 60 that are constructed from a non-skid material to help prevent sliding of the base 20 on counter surfaces 12.

Each container bottle portion 40 also includes indicia 62 indicating at least the type of liquid concentrate in the container.

In use, the user 11 carries the kit 10, using handles 26, to a substantially horizontal surface, such as the counter surface 12 shown in FIG. 1, that has an available potable water supply, such as the faucet 13.

After placing the kit 10 on the counter surface 12, the user 11 unlocks each container that the user 11 anticipates will be needed by twisting the spout 52 and releasing the lock mechanism 50. This allows the spout 52 to extend from the bottle portion 40 and the container is then ready for pumping.

The user 11 then obtains water from the faucet 13 in a cup 14, and positions the cup 14 under one of the spouts 52. The user 11 may choose to support the cup 14 by hand or by placing the cup 14 on the grate 58. By then pressing down on the spout 52, the user 11 causes the pump 44 to discharge the liquid concentrate through the spout 52. Any drips or liquids that miss the cup 14 are caught in the drip tray 56. The user 11 repeats the process using the various containers in order to make any number of beverage flavors using combinations of the various concentrated syrup flavors.

Once the beverages are completed, the user 11 depresses and twists each spout 52 that was used. This locks each spout 52 in the down and sealed position. The user 11 then removes the drip tray 56 and grate 58, as shown in FIG. 4, for convenient washing prior to returning for insertion between the sidewalls' forward extensions 28. After cleaning and repositioning the drip tray 56 and grate 58 the user 11 can easily transport the kit 10 by again grasping the handles 26 and carrying the kit 10 to the next location.

With respect to the above description then, it is to be realized that the optimum material and dimensional relationships for the parts of the portable liquid dispensing kit 10, will include variations in size, materials, shape, and form, which will occur to those skilled in the art upon review of the present disclosure. For example, the base 20, back wall 22, sidewalls 24, handles 26, sidewall forward extensions 28, drip tray 56, grate 58, container bottle portions 40, and the pump assembly 44 are, in various embodiments, constructed from various woods, metals, glasses and plastics.

All equivalent relationships to those illustrated in the drawings and described in the specification are intended to be encompassed by the present invention.

What is claimed as new and desired to be protected by Letters Patent is set forth in the appended claims:

1. A kit for transporting and using liquid containers, the containers having a bottle portion having a base, the container further having a pump and a spout for pumping liquid from the container, comprising:

a housing assembly having:

a base;

a back wall; and a left sidewall and a right sidewall extending from the back wall, the left and right sidewalls each having an outwardly-curved top portion extending from the walls in a substantially horizontal orientation, the left and right sidewalls each having a forwardly-extending portion of reduced height;

a retainer portion having a plurality of receptacles, each receptacle shaped for receiving one of the container bottle portions;

a tray, the tray having a basin, the tray being shaped for frictional securement between and against the left and right sidewalls' forwardly-extending portions, the liquid container spout being positioned to discharge liquids above the tray, the tray being removable; and a grate positioned on the tray, the grate being removable from the tray.

2. The kit of claim 1, wherein the container bottle portions fit tightly within the receptacles, the tight fit securing the containers in the receptacles to the extent necessary to overcome gravity when the retainer portion is inverted.

3. The kit of claim 1, wherein each receptacle has a side wall, the retainer portion further comprising a frictional element attached to the sidewall to frictionally secure the containers within the receptacles.

4. The kit of claim 3, wherein the frictional element is a cupped insert within the receptacle.

5. The kit of claim 1, wherein the housing further comprises anti-skid feet attached to the base.

6. The kit of claim 1, wherein the container pump has a locking mechanism, such that the locking mechanism secures the spout in a down position with no liquid discharge, and alternatively, the locking mechanism secures the spout in an up position allowing liquid discharge through the spout when the spout is depressed.

7. The kit of claim 6, wherein the pump locking mechanism is put in the locked position by pushing down on the spout and rotating the spout while the spout is down.

8. The kit of claim 1, wherein the container bottle portion further comprises a cap and a threaded top opening for attaching the cap, the pump being attachable to the container bottle portion threaded top opening when the cap is threadably removed.

9. The kit of claim 1, wherein the left and right sidewalls' forwardly-extending portions have a forward end, each of the forward ends being curved inwardly to partially encompass the tray.

10. A kit for transporting and dispensing liquid beverage mixes, comprising:

a plurality of containers, each container having a bottle portion having a base, each container further having a pump and a spout for pumping liquid from the container;

a housing assembly having:

a base;

a back wall; and a left sidewall and a right sidewall extending from the back wall, the left and right sidewalls each having an outwardly-curved top portion extending from the walls in a substantially horizontal orientation, the left and right sidewalls each having a forwardly-extending portion of reduced height;

a retainer portion having a plurality of receptacles, each receptacle shaped for receiving one of the container bottle portions;

a tray, the tray having a basin, the tray being shaped for frictional securement between and against the left and right sidewalls' forwardly-extending portions, the liquid container spout being positioned to discharge liquids above the tray, the tray being removable; and a grate positioned on the tray, the grate being removable from the tray.

11. The kit of claim 10, wherein the container bottle portions fit tightly within the receptacles, the tight fit securing the containers in the receptacles to the extent necessary to overcome gravity when the retainer portion is inverted.

12. The kit of claim 10, wherein each receptacle has a side wall, the retainer portion further comprising a frictional element attached to the sidewall to frictionally secure the containers within the receptacles.

13. The kit of claim 12, wherein the frictional element is a cupped insert within the receptacle.

14. The kit of claim 10, wherein the housing further comprises anti-skid feet attached to the base.

15. The kit of claim 10, wherein the container pump has a locking mechanism, such that the locking mechanism secures the spout in a down position with no liquid discharge, and alternatively, the locking mechanism secures the spout in an up position allowing liquid discharge through the spout when the spout is depressed.

16. The kit of claim 15, wherein the pump locking mechanism is put in the locked position by pushing down on the spout and rotating the spout while the spout is down.

17. The kit of claim 10, wherein the container bottle portion further comprises a cap and a threaded top opening for attaching the cap, the pump being attachable to the container bottle portion threaded top opening when the cap is threadably removed.

18. The kit of claim 10, wherein the left and right sidewalls' forwardly-extending portions have a forward end, each of the forward ends being curved inwardly to partially encompass the tray.

19. A kit for transporting and dispensing liquid beverage mixes, comprising:

a plurality of containers, each container having a bottle portion having a base, each container further having a pump and a spout for pumping liquid from the container, the container pump having a locking mechanism, such that the locking mechanism secures the spout in a down position with no liquid discharge, and alternatively, the locking mechanism secures the spout in an up position allowing liquid discharge through the spout when the spout is depressed, the pump locking mechanism being put in the locked position by pushing down on the spout and rotating the spout while the spout is down, and further wherein the container bottle portion further comprises a cap and a threaded top opening for attaching the cap, the pump being attachable to the container bottle portion threaded top opening when the cap is threadably removed;

a housing assembly having:

a base;

a back wall;

a left sidewall and a right sidewall extending from the back wall, the left and right sidewalls each having an outwardly-curved top portion extending from the walls in a substantially horizontal orientation, the left and right sidewalls each having a forwardly-extending portion of reduced height; and anti-skid feet attached to the base;

a retainer portion having a plurality of receptacles, each receptacle shaped for receiving one of the container bottle portions, each receptacle having a side wall, the retainer portion further comprising a cupped frictional element attached to the sidewall to frictionally secure the containers within the receptacles;

a tray, the tray having a basin, the tray being shaped for frictional securement between and against the left and right sidewalls' forwardly-extending portions, the liquid container spout being positioned to discharge liquids above the tray, the tray being removable; and a grate positioned on the tray, the grate being removable from the tray.

* * * * *